US011800929B2

(12) United States Patent
Lee et al.

(10) Patent No.: US 11,800,929 B2
(45) Date of Patent: Oct. 31, 2023

(54) PULL-OUT SYSTEM

(71) Applicant: SEGOS CO., LTD., Incheon (KR)

(72) Inventors: Doo Myun Lee, Incheon (KR); Sung Joon Kang, Incheon (KR); In Suk Ra, Bucheon-Si (KR); Jung Kyu Lim, Incheon (KR); Sung Woo Kim, Incheon (KR); Jae Hyuk Lim, Siheung-Si (KR); Dong Wook Kim, Seoul (KR)

(73) Assignee: SEGOS CO., LTD., Incheon (KR)

( * ) Notice: Subject to any disclaimer, the term of this patent is extended or adjusted under 35 U.S.C. 154(b) by 151 days.

(21) Appl. No.: 17/432,756

(22) PCT Filed: Mar. 11, 2020

(86) PCT No.: PCT/KR2020/003368
§ 371 (c)(1),
(2) Date: Aug. 20, 2021

(87) PCT Pub. No.: WO2020/184970
PCT Pub. Date: Sep. 17, 2020

(65) Prior Publication Data

US 2022/0142363 A1 May 12, 2022

(30) Foreign Application Priority Data

Mar. 12, 2019 (KR) ..... 10-2019-0028130

(51) Int. Cl.
*A47B 88/437* (2017.01)
*A47B 88/443* (2017.01)
*A47B 88/493* (2017.01)

(52) U.S. Cl.
CPC ..... *A47B 88/437* (2017.01); *A47B 88/443* (2017.01); *A47B 88/493* (2017.01);
(Continued)

(58) Field of Classification Search
CPC ... A47B 88/437; A47B 88/443; A47B 88/493; A47B 2210/0037; A47B 2210/007; A47B 2210/175
(Continued)

(56) References Cited

U.S. PATENT DOCUMENTS 3,722,964 A 3/1973 Chitester et al.
4,974,912 A * 12/1990 Rask ..... E06B 3/5045 312/331
(Continued)

FOREIGN PATENT DOCUMENTS

KR 10-2016-0021098 A 2/2016
KR 2018-0010559 A 1/2018
(Continued)

*Primary Examiner* — James O Hansen
(74) *Attorney, Agent, or Firm* — NKL LAW; Jae Youn Kim

(57) ABSTRACT

An embodiment of the present invention provides a pull-out system comprising: at least two slide rails each having a fixed rail, a middle rail slidably arranged on the fixed rail, and a movable rail slidably arranged on the middle rail; and a synchronization means for synchronizing the movement of the movable rail, wherein the synchronization means comprises a roller unit, a synchronization bar connected to the roller unit, and a deflectable element having an end portion fixe to the roller unit and an opposite end portion connected to the movable rail, and the movable rail is configured to move as much as the amount of rotation of the roller unit.

8 Claims, 8 Drawing Sheets

(52) U.S. Cl.
CPC . *A47B 2210/007* (2013.01); *A47B 2210/0037* (2013.01); *A47B 2210/175* (2013.01)

(58) Field of Classification Search
USPC ..... 312/331
See application file for complete search history.

(56) References Cited

U.S. PATENT DOCUMENTS

| | | | | |
|---|---|---|---|---|
| 8,517,482 | B2 * | 8/2013 | Carey | A47B 67/04 312/331 |
| 9,675,174 | B2 * | 6/2017 | Jahrling | A47B 88/45 |
| 2010/0219727 | A1 * | 9/2010 | Aguilar Ante | A47B 88/447 312/319.1 |
| 2011/0210655 | A1 * | 9/2011 | Brown | F25D 25/025 312/334.7 |
| 2016/0345730 | A1 | 12/2016 | Lim | |
| 2017/0020285 | A1 | 1/2017 | Schallert | |
| 2017/0086584 | A1 * | 3/2017 | Rehage | A47B 88/473 |

FOREIGN PATENT DOCUMENTS

| | | | |
|---|---|---|---|
| KR | 10-2018-0099249 | A | 9/2018 |
| WO | 2010017505 | A1 | 2/2010 |

* cited by examiner

PULL-OUT SYSTEM

TECHNICAL FIELD

The present invention relates to a pull-out system, and more particularly, to a pull-out system including at least two slide rails that each have a fixed rail, a middle rail slidably arranged on the fixed rail, and a movable rail slidably arranged on the middle rail, and a synchronization unit that is provided to be easily attached to and detached from the slide rails provided on both sides thereof to perform synchronization.

BACKGROUND ART

In general, drawer assemblies are coupled to mounting structures such as refrigerators, dishwashers, ovens, or drawers so that objects can be pulled out and retracted into the mounting structures.

The drawer assembly is provided with slide rails so that the drawer may be easily pulled out from the mounting structure and return to an original position thereof. Further, the slide rail is provided with a rolling unit in the form of a ball or a roller and may thus more smoothly move when sliding so that user convenience can be improved.

In general, the slide rail includes a fixed rail fixed to a wall surface of a drawer installation space and one or more movable rails slidably installed on the fixed rail. Thus, as the movable rails slide on the fixed rail, the drawer can be easily pulled out and retracted.

Meanwhile, since the slide rails on both sides of the drawer are not restricted by each other and are individually operated, when there is a difference in the amount of movement between two slide rails, the position of the drawer is misaligned, and thus a greater force is taken to pull out and retract the drawer and noise occurs due to a pinching movement.

Accordingly, in order to solve the above problems, a synchronization unit which reduces the difference in the amount of movement between the two slide rails and enables smooth movement is more needed.

DISCLOSURE

Related Art Document (Patent Document 1) Korean Patent Publication No. 2018-0010559 (Jan. 31, 2018)

Technical Problem

The present invention is directed to providing a pull-out system including at least two slide rails that each have a fixed rail, a middle rail slidably arranged on the fixed rail, and a movable rail slidably arranged on the middle rail, and a synchronization unit that is provided to be easily attached to and detached from the slide rails provided on both sides thereof to perform synchronization.

Technical Solution

One aspect of the present invention provides a pull-out system including at least two slide rails that each have a fixed rail, a middle rail slidably arranged on the fixed rail, and a movable rail slidably arranged on the middle rail; and a synchronization unit which synchronizes movements of the respective movable rails, wherein the synchronization unit includes a roller part, a synchronization bar connected to the roller part, and a deflectable element having one end fixed to the roller part and the other end connected to the movable rail, and the movable rail is moved by a rotation amount of the roller part.

The synchronization unit may further include a rail insertion part, and the rail insertion part is insertion-fitted to the fixed rail.

The synchronization unit may further include a leaf spring that maintains a tension of the deflectable element.

The synchronization unit may further include an auxiliary roller part that changes a direction of the deflectable element, the auxiliary roller part may be provided with a first auxiliary roller and a second auxiliary roller, and the deflectable element may be mounted on the first auxiliary roller and the second auxiliary roller in a rolamite manner.

The auxiliary roller part may be coupled to the middle rail through a rail connection member connected to a central shaft of the first auxiliary roller or the second auxiliary roller.

The synchronization unit may be provided with a first box part and a second box part formed on one side of the first box part in a lengthwise direction, the roller part may be provided in the first box part, the auxiliary roller part may be provided in the second box part, and the first auxiliary roller and the second auxiliary roller may be moved, respectively, along a first guide groove and a second guide groove formed in the second box part, respectively.

The roller part may include a first roller and a second roller spaced apart from each other, and one end of the synchronization bar may be connected to a central shaft of the first roller.

The first roller may have a first space part formed by a first middle plate, one end of the leaf spring may be fixed to the first space part, the second roller may have a second space part and a third space part formed by a second middle plate and an outer plate parallel to each other, the other end of the leaf spring may be fixed to the second space part, the leaf spring may be mounted on the first space part and the second space part in an "S" shape, and one end of the deflectable element may be fixed to the third space part.

The first roller may have a first toothed part on an outer circumferential surface thereof, the second roller may have a second toothed part engaged with the first toothed part on the outer circumferential surface thereof and an inter-space part defined by the second toothed part and an outer plate, one end of the deflectable element may be fixed to the inter-space part, and the leaf spring may be mounted in an inner space of the second roller.

Advantageous Effects

According to one embodiment of the present invention, a pull-out system is provided with a synchronization unit that is easily attached to and detached from a slide rail, thereby improving assembling convenience and productivity.

Further, the synchronization unit can synchronize the movement of the slide rail through a roller part, a synchronization bar connected to the roller part, and a deflectable element having one end connected to the roller part and the other end connected to a movable rail.

Further, the tension of the deflectable element is maintained due to a leaf spring provided in the roller part, and thus more sensible movement of the slide rail can be achieved.

The effects of the present invention are not limited to the above effects and should be understood to include all effects that may be deduced from the detailed description of the present invention or the configuration of the present invention described in the appended claims.

MODES OF THE INVENTION

Figure 1:
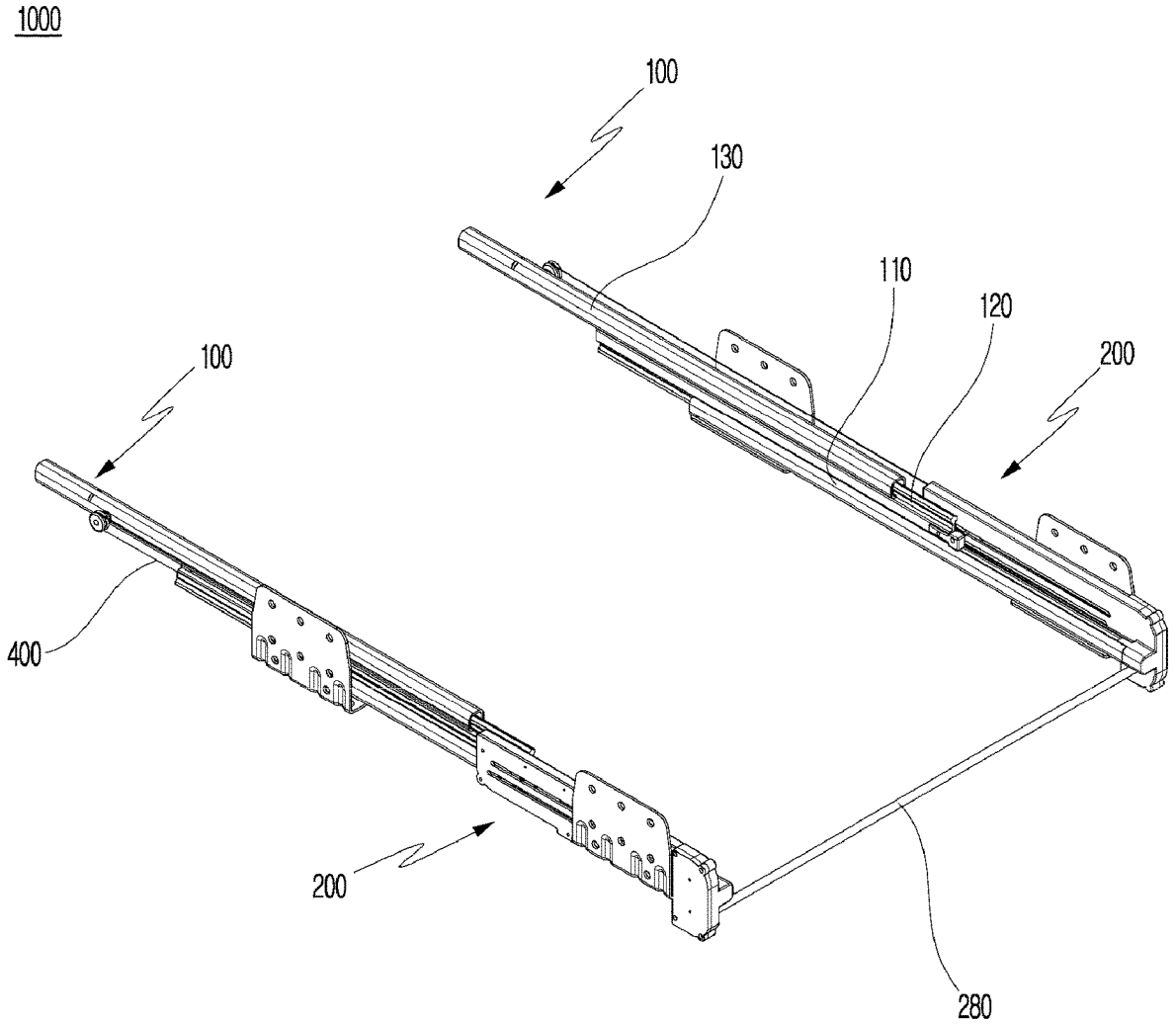
FIG. 1 is a perspective view of a pull-out system according to one embodiment of the present invention.

Hereinafter, the present invention will be described with reference to the accompanying drawings. However, the present invention may be implemented in various different forms and is not limited to embodiments described herein. Further, in the drawings, parts irrelevant to the description are omitted in order to clearly describe the present invention, and throughout the specification, the same reference numerals are assigned to the same parts.

Throughout the specification, when a first part is "connected" to a second part, this includes not only a case in which the first part is "directly connected" to the second part but also a case in which the first part is indirectly connected to the second part with a third part interposed therebetween. Further, when a part "includes" a component, this means that another component is not excluded but may be further included unless otherwise stated.

Hereinafter, embodiments of the present invention will be described in detail with reference to the accompanying drawings.

Figure 2:
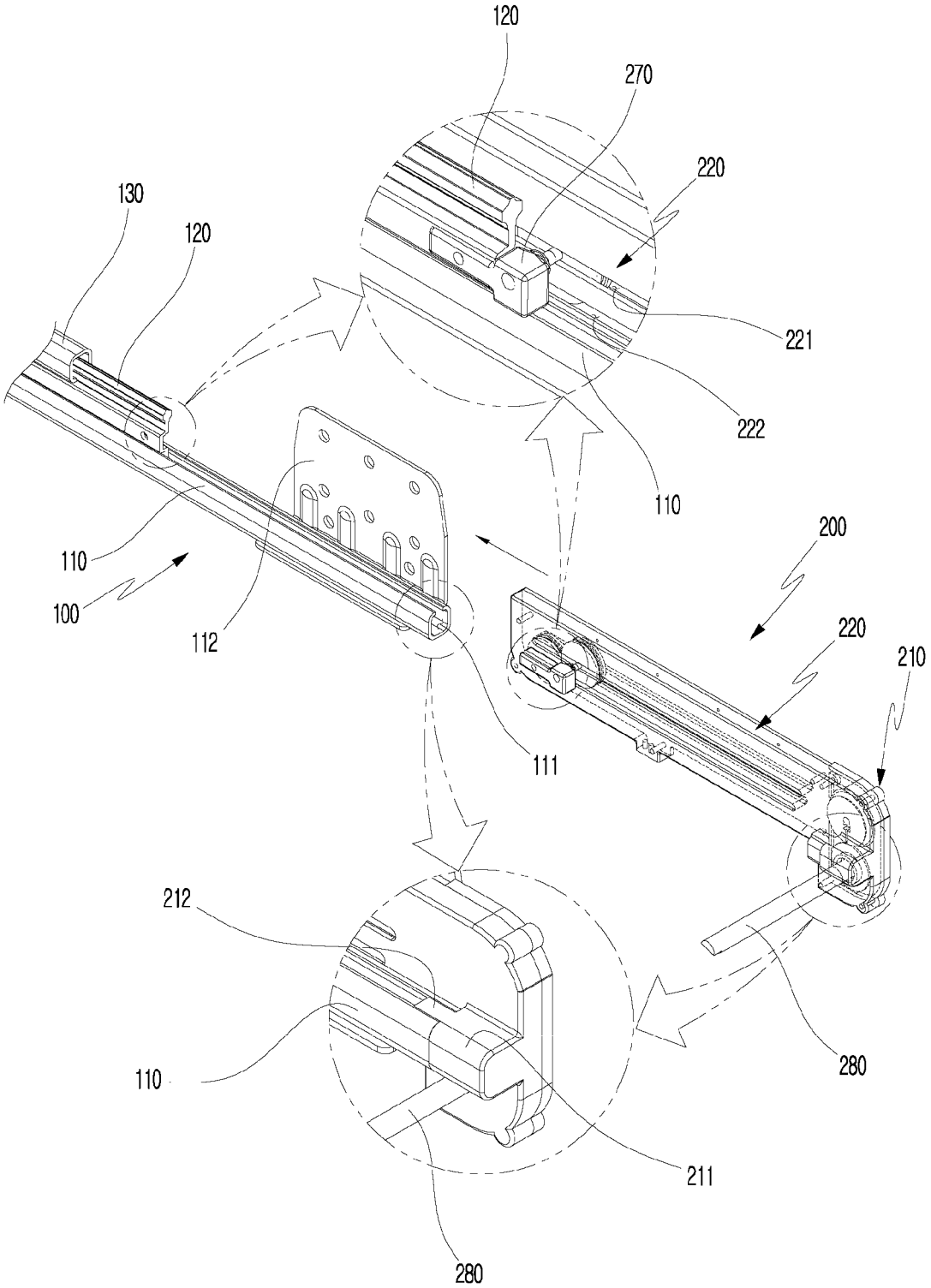
FIG. 2 shows a perspective view and partially enlarged views of a synchronization unit according to one embodiment of the present invention.

FIG. 1 is a perspective view of a pull-out system according to one embodiment of the present invention, and FIG. 2 shows a perspective view and partially enlarged views of a synchronization unit according to one embodiment of the present invention.

Referring to FIGS. 1 and 2, a pull-out system 1000 according to the present invention includes a pair of slide rails 100 and a synchronization unit 200 that is detachably provided on the slide rails 100 and synchronizes the movements of the slide rails 100.

The slide rails 100 each include a fixed rail 110 that is fixed through a bracket 112 to a side wall of a mounting structure, such as a drawer, a dishwasher, and a refrigerator, and a movable rail 130 provided to be slidably movable on the fixed rail 110. Thus, the slide rail 100 is formed in a structure in which the movable rail 130 retracts and pulls out an object while sliding in a direction of one side or the other side according to user's needs.

Meanwhile, the slide rail 100 may further include a middle rail 120 provided to be slidably movable between the fixed rail 110 and the movable rail 130. In more detail, the middle rail 120 and the movable rail 130 are moving rails, the middle rail 120 may be slidably installed on the fixed rail 110, and the movable rail 130 may be slidably installed on the middle rail 120.

As a result, since the movable rail 130 may move relative to the middle rail 120 moving relative to the fixed rail 110, the length of the slide rail 100 may be increased as needed. Thus, the slide rail 100 can be used in drawers having various sizes.

Further, rolling units such as balls and rollers are installed between the fixed rail 110, the middle rail 120, and the movable rail 130 to reduce friction between the rails, and thus a smoother sliding movement may be achieved.

Referring to FIG. 2, the synchronization unit 200 including a synchronization bar 280 for synchronizing the movements of the two slide rails 100 may be detachably provided on the slide rail 100.

The synchronization unit 200 is mounted on the two slide rails 100, is connected through the synchronization bar 280, and thus synchronizes the movements of the slide rails 100 so that when one slide rail 100 performs an opening operation, the other slide rail 100 also performs an opening operation, and when the one slide rail 100 performs a closing operation, the other slide rail 100 also performs a closing operation.

The synchronization unit 200 may be formed in a box shape and may be mounted by being inserted into a space formed between the "L"-shaped bracket 112 provided in the fixed rail 110 and the slide rail 100.

In more detail, as will be described below, the synchronization unit 200 is provided with a rail insertion part 212 on one side thereof, a body of the synchronization unit 200 is formed to be inserted into the space formed between the "L"-shaped bracket 112 provided in the fixed rail 110 and the slide rail 100, and the rail insertion part 212 is formed to be insertion-fitted into a hollow 111 formed in the fixed rail 110. According to one embodiment, the cross-sectional shape of the rail insertion part 212 may be formed to correspond to the shape of the hollow 111 of the fixed rail 110. In this case, the synchronization unit 200 may further include an insertion support part 211 that may serve as a stopper on one side thereof in order to prevent excessive insertion of the rail insertion part 212.

As a result, the synchronization unit 200 may be more easily attached to and detached from the slide rail 100, and thus assembly convenience and production/yieldability of the pull-out system 1000 can be improved.

Figure 3:
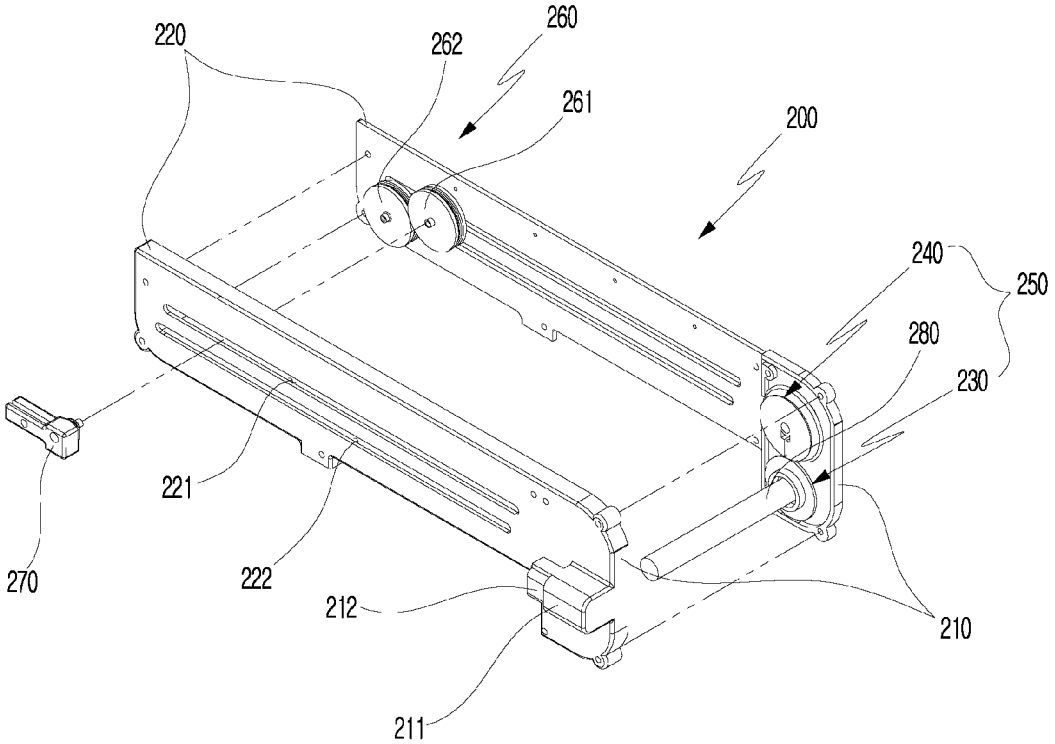
FIG. 3 shows an exploded perspective view and a side view of the synchronization unit when viewed in one direction according to one embodiment of the present invention.
Figure 3:
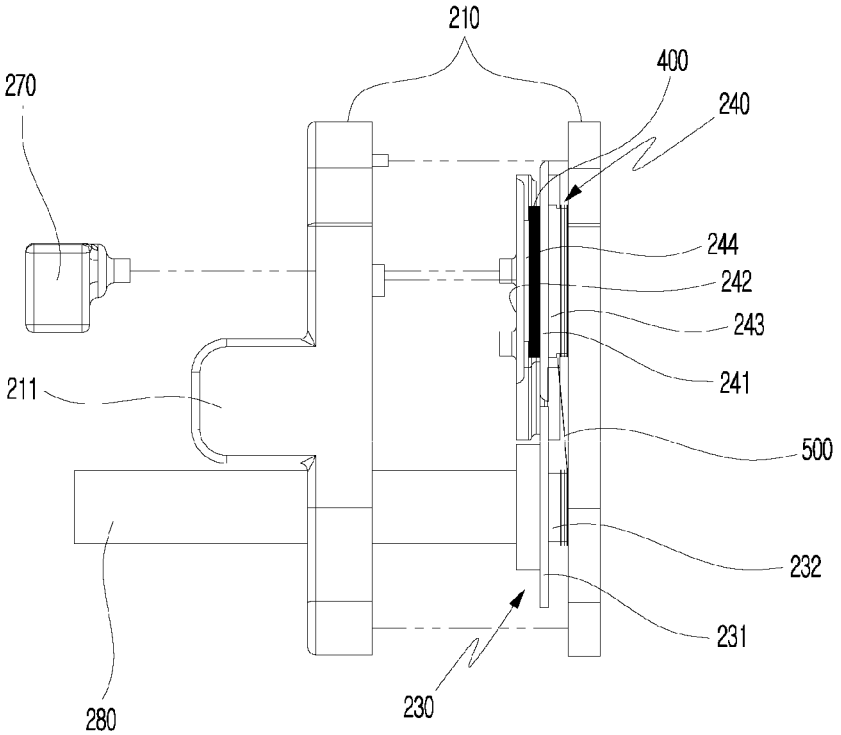
Figure 4:
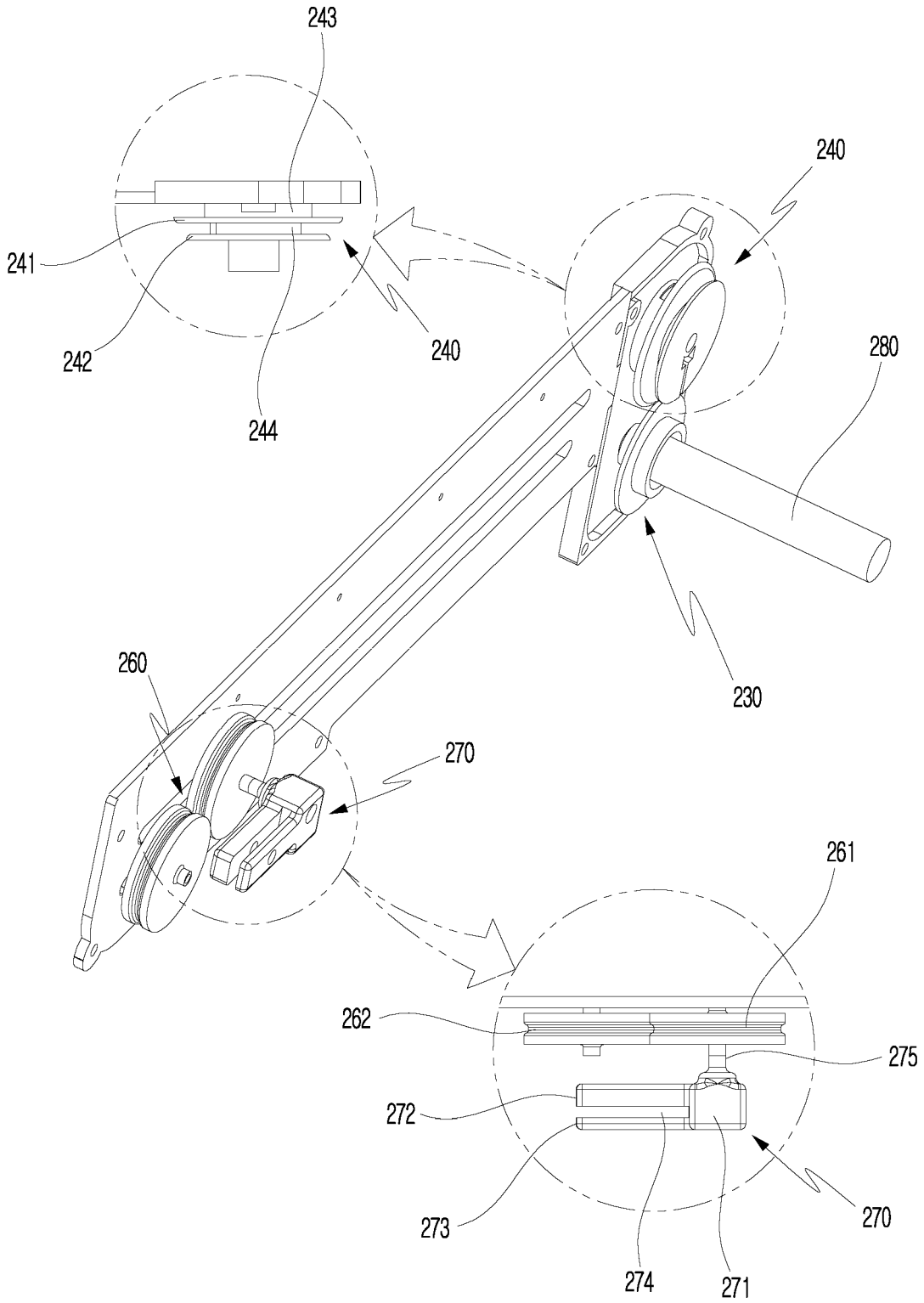
FIG. 4 shows an exploded perspective view and partially enlarged views of the synchronization unit when viewed in the other direction according to one embodiment of the present invention.
Figure 5:
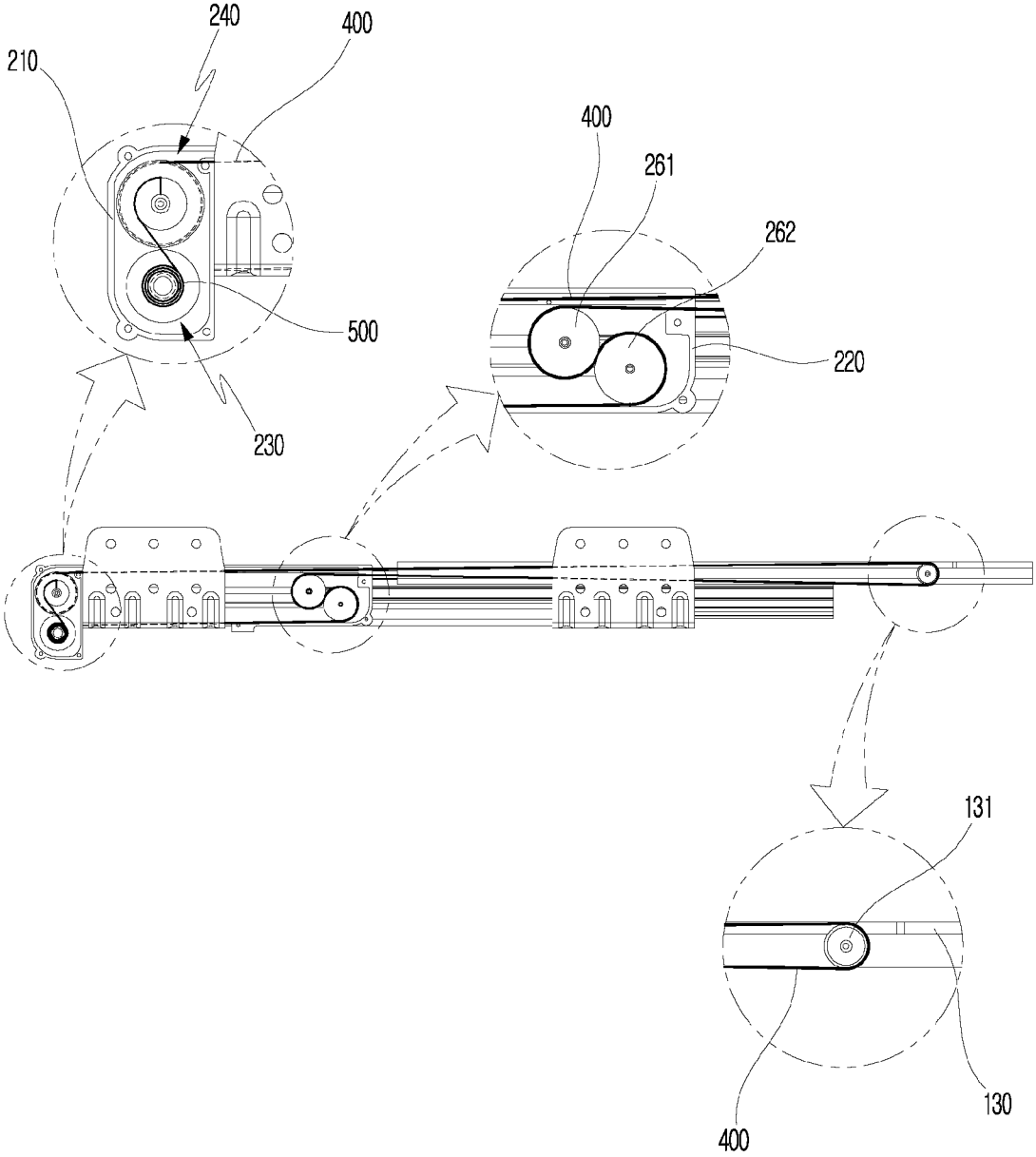
FIG. 5 shows a front view and partially enlarged views of a slide rail to which the synchronization unit is applied according to one embodiment of the present invention.

FIG. 3 shows an exploded perspective view and a side view of the synchronization unit when viewed in one direction according to one embodiment of the present invention, FIG. 4 shows an exploded perspective view and partially enlarged views of the synchronization unit when viewed in the other direction according to one embodiment of the present invention, and FIG. 5 shows a front view and partially enlarged views of a slide rail to which the synchronization unit is applied according to one embodiment of the present invention.

Referring to FIGS. 3 to 5, the synchronization unit 200 of the present invention includes a first box part 210 and a second box part 220 formed on one side of the first box part 210 in the lengthwise direction.

The first box part 210 has a roller part 250 therein, and the roller part 250 is connected to the roller part 250 of the other slide rail 100 paired through the synchronization bar 280. Further, a deflectable element 400 is mounted on the roller part 250, and as will be described below, the deflectable element 400 is connected to a fixed roller part 131 of the movable rail 130 to transfer a tension of the deflectable element 400 to the movable rail 130, and when the movable rail 130 is pulled out, an extra deflectable element 400 is provided. The deflectable element 400 may be a wire or a band, preferably, a metal band.

Further, the pull-out system 1000 drives the overall motion of the slide rail 100 using the tension of the deflectable element 400, and the roller part 250 may further include a leaf spring 500 to maintain the tension of the deflectable element 400 connected to the movable rail 130. In the pull-out system 1000, the roller part 250 of one slide rail 100 is rotated together with the roller part 250 of the other slide rail 100 paired through the synchronization bar 280, and the movable rail 130 is pulled out by the rotation amount of the two roller parts 250. As a result, the movements of the two slide rails 100 may be synchronized.

According to one embodiment, the roller part 250 of the present invention includes a first roller 230 and a second roller 240 spaced apart from each other, and preferably, the second roller 240 is provided above the first roller 230 to be spaced apart from the first roller 230.

One end of the synchronization bar 280 is connected to a central shaft of the first roller 230, one end of the leaf spring 500 is fixed to a first space part 232 formed by a first middle plate 231, and the extra leaf spring 500 is rolled and wound.

The second roller 240 is provided with a second space part 243 and a third space part 244 formed by a second middle plate 241 and an outer plate 242 parallel to each other, the other end of the leaf spring 500 is fixed to the second space part 243, and the leaf spring 500 is formed in an "S" shape in the first space part 232 and the second space part 243. Further, one end of the deflectable element 400 is fixed to the third space part 244, the extra deflectable element 400 is rolled and wound, and accordingly, when the movable rail 130 connected to the deflectable element 400 is pulled out, the extra deflectable element 400 may be provided.

That is, when the movable rail 130 connected to the deflectable element 400 is pulled out, the second roller 240 to which the one end of the deflectable element 400 is fixed rotates, the leaf spring 500 connected to the first roller 230 and the second roller 240 in an "S" shape is wound, and at the same time, the first roller 230 also rotates. Further, one first roller part 230 is rotated together with the other first roller part 230 paired through the synchronization bar 280, and the movable rail 130 is pulled out by the rotation amount of the two roller parts 250. As a result, the movements of the two slide rails 100 can be synchronized. In this case, the leaf spring 500 may serve to maintain the tension of the deflectable element 400, and when a force applied in a pull-out direction is not applied, the movable rail 130 may be automatically restored in a retraction direction by an elastic force of the leaf spring 500.

Continuously, referring to FIGS. 3 to 5, the second box part 220 includes a first guide groove 221 and a second guide groove 222 formed in the lengthwise direction, and preferably, the first guide groove 221 and the second guide groove 222 may be formed to be vertically parallel to each other.

An auxiliary roller part 260 including a first auxiliary roller 261 and a second auxiliary roller 262 may be provided inside the second box part 220, a central shaft of the first auxiliary roller 261 may move along the first guide groove 221, and a central shaft of the second auxiliary roller 262 may move along the second guide groove 222.

In this case, the auxiliary roller part 260 is coupled to the middle rail 120 through a rail connection member 270 connected to the central shaft of the first auxiliary roller 261 and moves together with the middle rail 120 when the middle rail 120 moves. Further, the deflectable element 400 is mounted on the first auxiliary roller 261 and the second auxiliary roller 262 in a rolamite manner, and accordingly, the second auxiliary roller 262 moves together due to the deflectable element 400 when the first auxiliary roller 261 connected to the middle rail 120 moves. That is, the auxiliary roller part 260 changes the movement direction of the deflectable element 400 and serves to assist the slide rail 100 to be retracted and pulled out more smoothly.

Referring to FIG. 4, the rail connection member 270 includes a support part 271 and a first leg part 272 and a second leg part 273 formed on the support part and parallel to each other, and a fitting space part 274 may be formed between the first leg part 272 and the second leg part 273. The middle rail 120 may be insertion-fitted and/or pin-fixed to the fitting space part 274, and the support part 271 is connected to the central shaft of the first auxiliary roller 261 through a fixing pin 275.

Referring to FIG. 5, the deflectable element 400 starts with one end fixed to the second roller 240, is deflected by approximately 180 degrees by the fixed roller part 131 formed at one end of the movable rail 130, then proceeds to the auxiliary roller part 260, is changed to an "S" shape in the auxiliary roller part 260 in the rolamite manner, and then the other end is fixed to either the first box part 210 or the second box part 220. In this case, as described above, the tension of the deflectable element 400 is maintained by the leaf spring 500 mounted on the roller part 250. As a result, when the slide rail 100 is pulled out, the synchronization movement of the two slide rails 100 by the synchronization bar 280 can be performed more smoothly.

Figure 6:
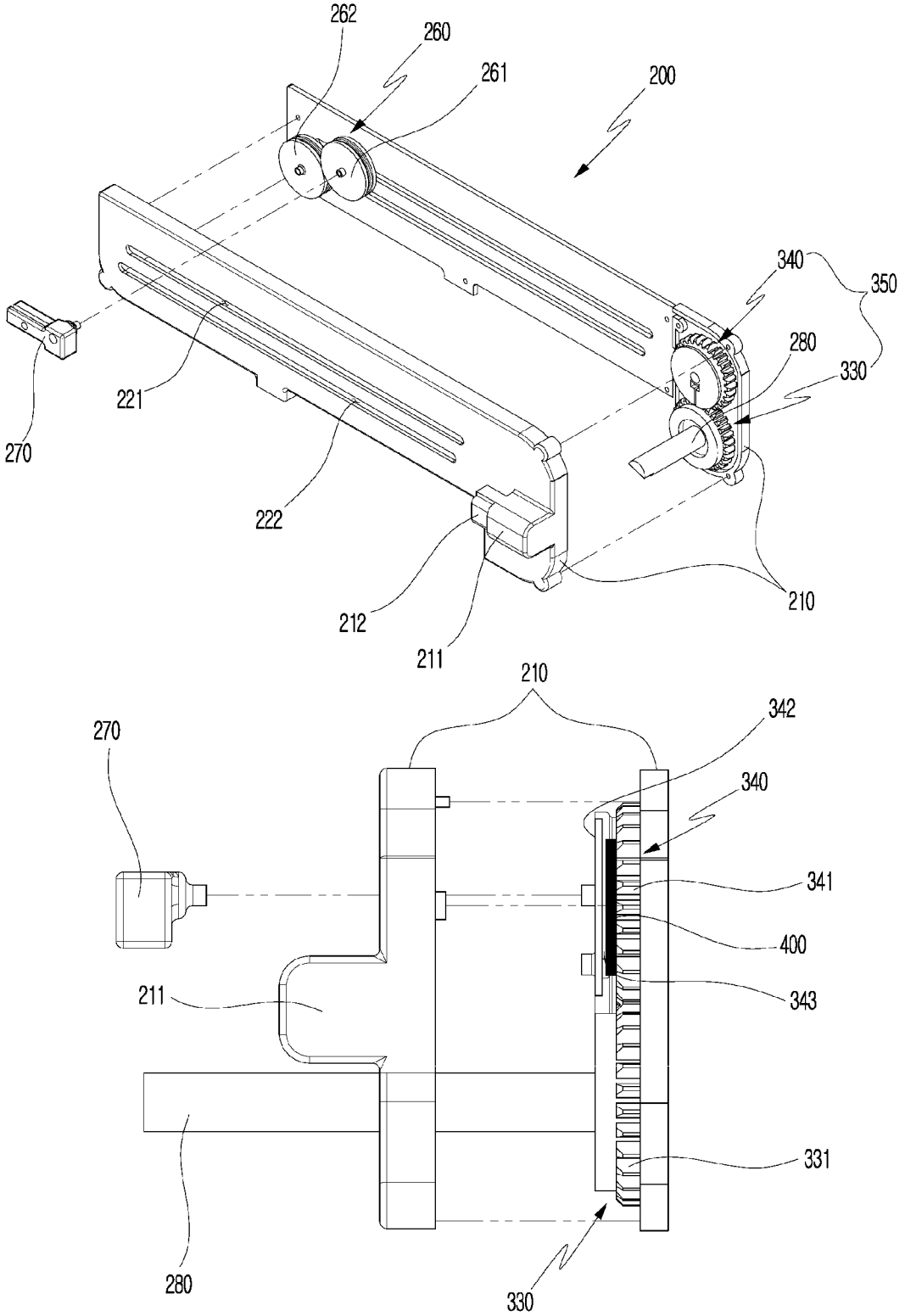
FIG. 6 shows an exploded perspective view and a side view of the synchronization unit when viewed in one direction according to another embodiment of the present invention.
Figure 7:
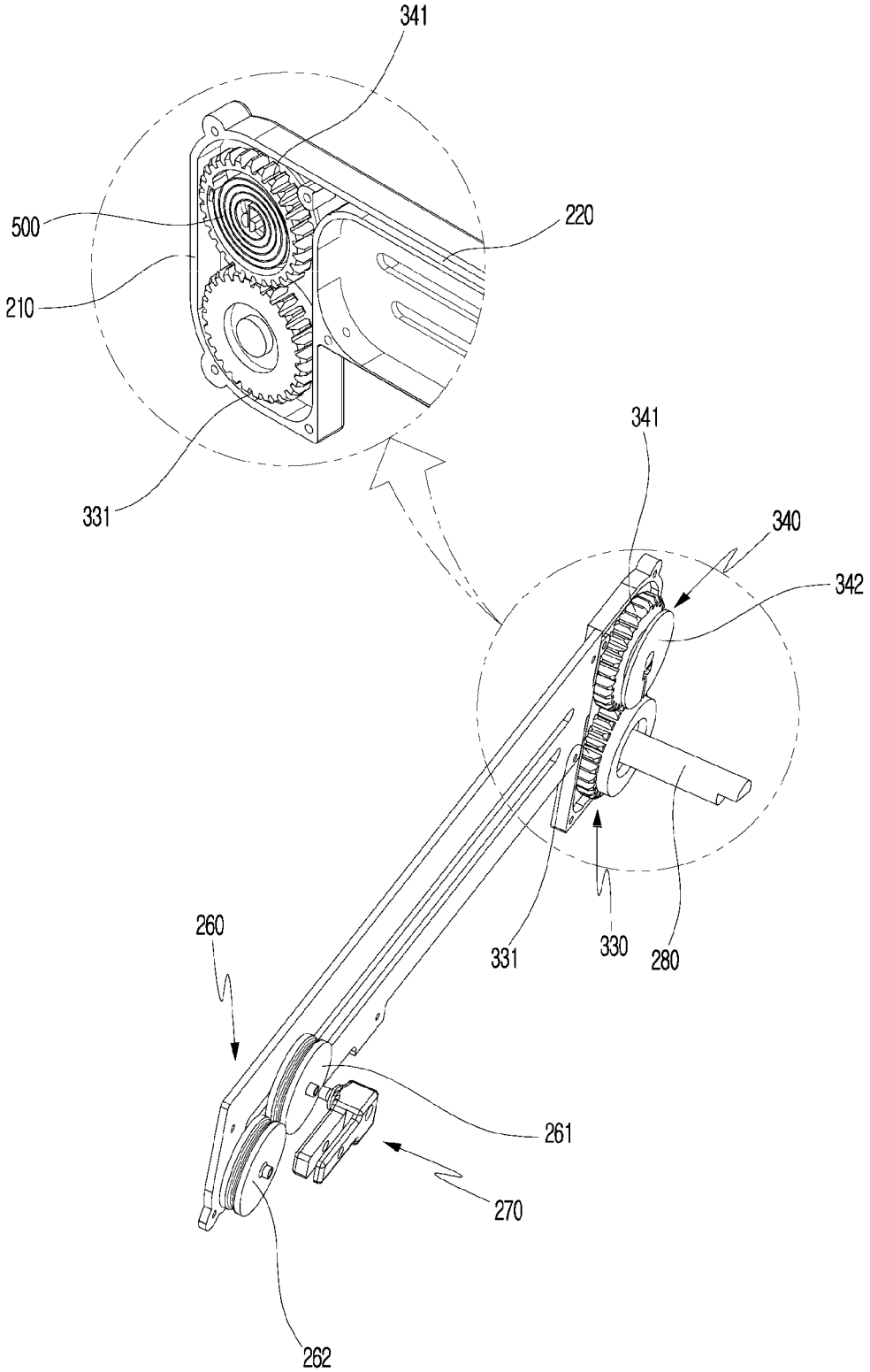
FIG. 7 shows an exploded perspective view and a partially enlarged view of the synchronization unit when viewed in the other direction according to another embodiment of the present invention.
Figure 8:
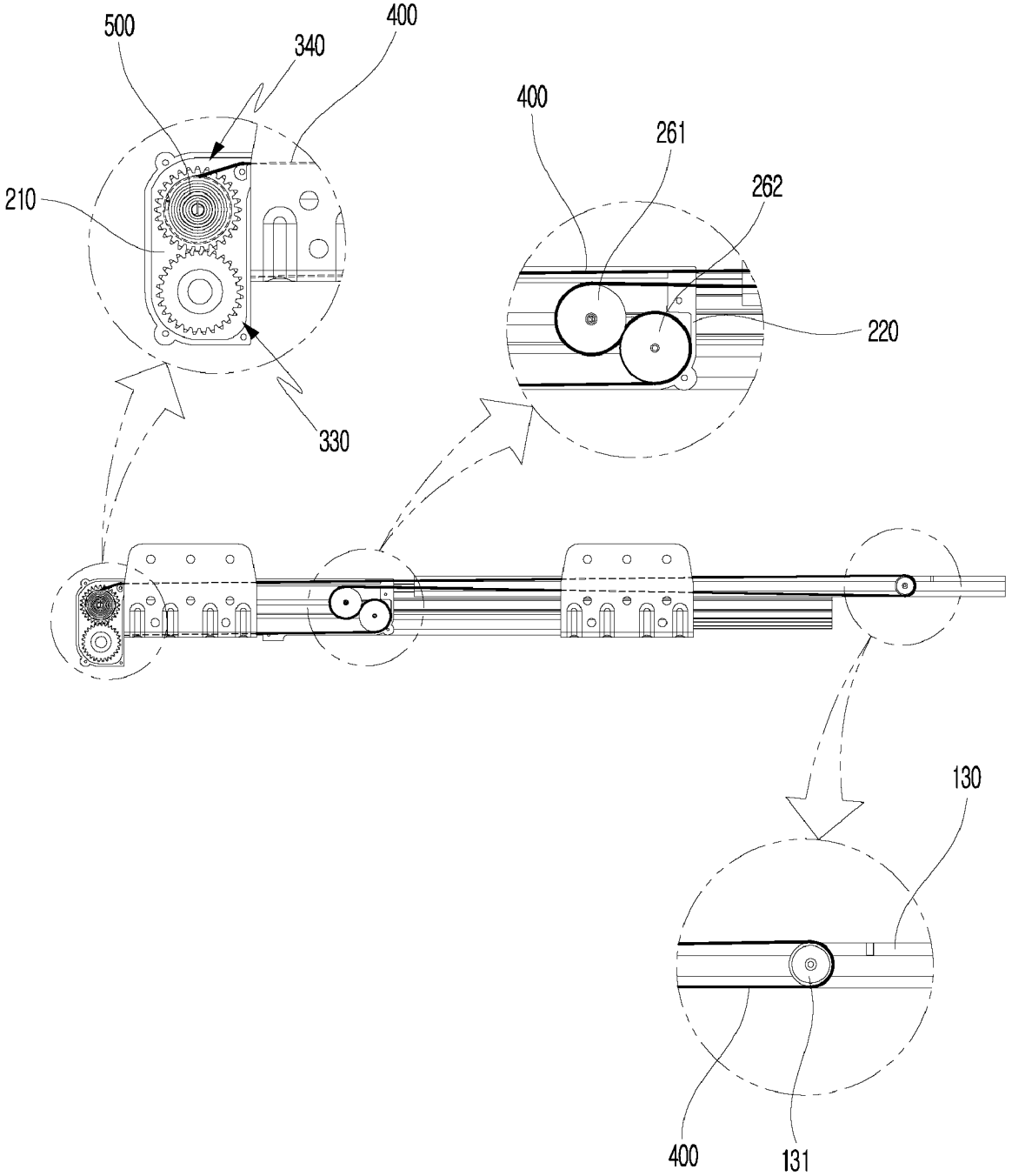
FIG. 8 shows a front view and partially enlarged views of the slide rail to which the synchronization unit is applied according to another embodiment of the present invention.

FIG. 6 shows an exploded perspective view and a side view of the synchronization unit when viewed in one direction according to another embodiment of the present invention, FIG. 7 shows an exploded perspective view and a partially enlarged view of the synchronization unit when viewed in the other direction according to another embodiment of the present invention, and FIG. 8 shows a front view and partially enlarged views of the slide rail to which the synchronization unit is applied according to another embodiment of the present invention.

Hereinafter, a difference from the above-described embodiment will be mainly described.

Referring to FIGS. 6 to 8, the synchronization unit 200 of the present invention includes a first box part 210 and a second box part 220 formed on one side of the first box part 210 in the lengthwise direction.

The first box part 210 has a roller part 350 therein, and the roller part 350 is connected to the roller part 350 of the other slide rail 100 paired through the synchronization bar 280. Further, the deflectable element 400 is mounted on the roller part 350, and as is described above, the deflectable element 400 is connected to the fixed roller part 131 of the movable rail 130 to transfer a tension of the deflectable element 400 to the movable rail 130, and when the movable rail 130 is pulled out, an extra deflectable element 400 is provided. The deflectable element 400 may be a wire or a band, preferably, a metal band.

Further, the pull-out system 1000 drives the overall motion of the slide rail 100 using the tension of the deflectable element 400, and the roller part 350 may further include a leaf spring 500 to maintain the tension of the deflectable element 400 connected to the movable rail 130. In the pull-out system 1000, the roller part 350 of one slide rail 100 is rotated together with the roller part 350 of the other slide rail 100 paired through the synchronization bar 280, and the movable rail 130 is pulled out by the rotation amount of the two roller parts 350. As a result, the movements of the two slide rails 100 may be synchronized.

According to one embodiment, the roller part 350 of the present invention includes a first roller 330 and a second roller 340 spaced apart from each other, and preferably, the second roller 340 is provided above the first roller 330 to be spaced apart from the first roller 330.

One end of the synchronization bar 280 is connected to the first roller 330, and a first toothed part 331 is provided on the outer circumferential surface thereof.

The second roller 340 is provided with a second toothed part 341 engaged with the first toothed part 331 on the outer circumferential surface thereof and an inter-space part 343 defined by the second toothed part 341 and an outer plate 342 parallel to the second toothed part 341. One end of the deflectable element 400 is fixed to the inter-space part 343, the extra deflectable element 400 is rolled and wound, and accordingly, when the movable rail 130 connected to the deflectable element 400 is pulled out, the extra deflectable element 400 may be provided.

Further, the leaf spring 500 is rolled and provided in the inner space of the second roller 340, one end of the leaf spring 500 is fixed to the central axis of the second roller 340, and the other end of the leaf spring 500 is fixed to the inner surface of the second roller 340.

That is, when the movable rail 130 connected to the deflectable element 400 is pulled out, the second roller 340 to which one end of the deflectable element 400 is fixed is rotated, the first toothed part 331 of the first roller 330 and the second toothed part 341 of the second roller 340 are engaged with each other, and thus the first roller 330 also rotates at the same time. Further, one first roller part 330 is rotated together with the other first roller part 330 paired through the synchronization bar 280, and the movable rail 130 is pulled out by the rotation amount of the two roller parts 350. As a result, the movements of the two slide rails 100 may be synchronized. In this case, the leaf spring 500 may serve to maintain the tension of the deflectable element 400, and when a force applied in a pull-out direction is not applied, the movable rail 130 may be automatically restored in a retraction direction by an elastic force of the leaf spring 500.

In this way, the pull-out system 1000 of the present invention includes the synchronization unit 200 that is easily attached to and detached from the slide rail 100, and thus assembling convenience and productivity can be improved. Further, the overall movement of the slide rail 100 is driven by the tension of the deflectable element 400, and in order to maintain the tension of the deflectable element 400 connected to the movable rail 130, the movement of the slide rail 100 can be more easily synchronized through the roller parts 250 and 350 to which the leaf spring 400 is applied and the synchronization bar 280 connected to the roller parts 250 and 350.

The above description of the present invention is merely illustrative, and those skilled in the art to which the present invention pertains can understand that the present invention can be easily modified in other specific forms without changing the technical spirit or essential features of the present invention. Therefore, it should be understood that the embodiments described above are illustrative but not limiting in all aspects. For example, components described as a single type may be implemented in a dispersed form, and likewise, components described as a dispersed form may also be implemented in a coupled form.

The scope of the present invention is indicated by the appended claims, and all changes or modifications derived from the meaning and scope of the appended claims and equivalent concepts thereof should be construed as being included in the scope of the present invention.

DESCRIPTION OF REFERENCE NUMERALS

1000: Pull-out system
100: Slide rail
110: Fixed rail
120: Middle rail
130: Movable rail
200: Synchronization unit
210: First box part
220: Second box part
230, 330: First roller
240, 340: Second roller
250, 350: Roller part
260: Auxiliary roller part
270: Rail connection member
280: Synchronization bar

The invention claimed is:

1. A pull-out system comprising:

at least two slide rails that each have a fixed rail, a middle rail slidably arranged on the fixed rail, and a movable rail slidably arranged on the middle rail; and a synchronization unit which synchronizes movements of the respective movable rails, wherein the synchronization unit includes a roller part, a synchronization bar connected to the roller part, and a deflectable element having one end fixed to the roller part and the other end connected to the movable rail, and the movable rail is moved by a rotation amount of the roller part, and wherein the synchronization unit further includes an auxiliary roller part that changes a direction of the deflectable element, the auxiliary roller part is provided with a first auxiliary roller and a second auxiliary roller, and the deflectable element is mounted on the first auxiliary roller and the second auxiliary roller in a rolamite manner.

2. The pull-out system of claim 1, wherein the synchronization unit further includes a rail insertion part, and the rail insertion part is insertion-fitted to the fixed rail.

3. The pull-out system of claim 1, wherein the synchronization unit further includes a leaf spring that maintains a tension of the deflectable element.

4. The pull-out system of claim 3, wherein the roller part includes a first roller and a second roller spaced apart from each other, and one end of the synchronization bar is connected to a central shaft of the first roller.

5. The pull-out system of claim 1, wherein the auxiliary roller part is coupled to the middle rail through a rail connection member connected to a central shaft of one of the first auxiliary roller or the second auxiliary roller.

6. The pull-out system of claim 1, wherein the synchronization unit is provided with a first box part and a second box part formed on one side of the first box part in a lengthwise direction, the roller part is provided in the first box part, and the auxiliary roller part is provided in the second box part, and the first auxiliary roller and the second auxiliary roller are moved, respectively, along a first guide groove and a second guide groove formed in the second box part.

7. A pull-out system comprising:

at least two slide rails that each have a fixed rail, a middle rail slidably arranged on the fixed rail, and a movable rail slidably arranged on the middle rail; and a synchronization unit which synchronizes movements of the respective movable rails, wherein the synchronization unit includes a roller part, a synchronization bar connected to the roller part, and a deflectable element having one end fixed to the roller part and the other end connected to the movable rail, and the movable rail is moved by a rotation amount of the roller part, wherein the synchronization unit further includes a leaf spring that maintains a tension of the deflectable element, wherein the roller part includes a first roller and a second roller spaced apart from each other, and one end of the synchronization bar is connected to a central shaft of the first roller, wherein the first roller has a first space part formed by a first middle plate, and one end of the leaf spring is fixed to the first space part, the second roller has a second space part and a third space part formed by a second middle plate and an outer plate parallel to each other, the other end of the leaf spring is fixed to the second space part, and the leaf spring is mounted on the first space part and the second space part in an "S" shape, and one end of the deflectable element is fixed to the third space part.

8. A pull-out system comprising:

at least two slide rails that each have a fixed rail, a middle rail slidably arranged on the fixed rail, and a movable rail slidably arranged on the middle rail; and a synchronization unit which synchronizes movements of the respective movable rails, wherein the synchronization unit includes a roller part, a synchronization bar connected to the roller part, and a deflectable element having one end fixed to the roller part and the other end connected to the movable rail, and the movable rail is moved by a rotation amount of the roller part, wherein the synchronization unit further includes a leaf spring that maintains a tension of the deflectable element, wherein the roller part includes a first roller and a second roller spaced apart from each other, and one end of the synchronization bar is connected to a central shaft of the first roller, wherein the first roller has a first toothed part on an outer circumferential surface thereof, the second roller has a second toothed part engaged with the first toothed part on the outer circumferential surface thereof and an inter-space part defined by the second toothed part and an outer plate, and one end of the deflectable element is fixed to the inter-space part, and the leaf spring is mounted in an inner space of the second roller.

* * * * *